US005291641A

United States Patent [19]

Morino

[11] Patent Number: 5,291,641

[45] Date of Patent: Mar. 8, 1994

[54] SNAP BUCKLE

[75] Inventor: Atsuhiko Morino, Toyama, Japan

[73] Assignee: Yoshida Kogyo K.K., Tokyo, Japan

[21] Appl. No.: 76,873

[22] Filed: Jun. 15, 1993

[30] Foreign Application Priority Data

Jun. 15, 1992 [JP] Japan ..... 4-040823[U]

[51] Int. Cl.[5] ..... A44B 11/00

[52] U.S. Cl. ..... 24/625; 24/633; 24/664

[58] Field of Search ..... 24/625, 633, 634, 644, 24/664, 615, 616, 613, 618

[56] References Cited

U.S. PATENT DOCUMENTS 1,737,246 11/1929 Jones ..... 24/625
4,150,464 4/1979 Tracy ..... 24/615
4,672,725 6/1987 Kasai ..... 24/625
4,987,661 1/1991 Kasai ..... 24/625

*Primary Examiner*—Victor N. Sakran
*Attorney, Agent, or Firm*—Hill, Steadman & Simpson

[57] ABSTRACT

In a snap buckle, the plug member 1 has a pair of resilient locking strips, each having on its outer surface an engaging portion, and a pair of guide strips outside the locking strips, each having an inner edge portion substantially in alignment with the respective engaging portion. The companion socket member has a pair of locking walls and a pair of inwardly bent resilient push levers outside the locking walls. When inserting the plug member into the socket member, the engaging portions engages the locking walls to bring the inner edge portions of the guide strips into contact with the side surfaces of the locking walls, causing the pushing portions of the push levers to resiliently contact the heads of the locking strips. Pressing the pushing levers inwardly releases the connection of the plug and socket members. The guide strips prevents either any accidental release or any misinsertion.

4 Claims, 3 Drawing Sheets

SNAP BUCKLE

BACKGROUND OF THE INVENTION

1. Field of the Invention:

This invention relates generally to a snap buckle for a belt or strap of a garment, bag, helmet, sporting goods, etc.

2. Description of the Related Art:

FIG. 6 of the accompanying drawings shows a typical conventional snap buckle comprising female and male members, i.e. a flat tube shaped socket member B and a plate shaped plug member A releasably insertable into the socket member B. The male or plug member A has a pair of resiliently deformable legs C each having on its outer surface a stepped portion D. On the other hand, the female or socket member B has a socket portion E for receiving the legs C, a pair of locking portions F engageable with the respective stepped portions D of the plug member A, and a pair of resilient push levers G each having a pushing portion H adapted to be located outside the respective leg C for pushing the leg C to disengage the stepped portion D from the companion locking portion F. This conventional art is exemplified by Japanese Utility Model Publication No. Hei 1-30090 and Japanese Utility Model Laid-Open Publication No. Hei 2-145109.

With this conventional type buckle, partly since the plate shaped plug member A has a pair of legs C each having on its outer surface a stepped portion D, and partly since the flat tube shaped socket member B has a pair of locking portions F releasably engageable with the respective stepped portions D and a pair of resilient push levers G outside the locking portions F for pushing the free ends of the legs C to disengage the stepped portions D from the respective locking portions F, the plug and socket members A and B would be moved about one of the stepped portions D if the other stepped portion D of the plug member A is accidentally disengaged from the companion locking portion F as an outward pulling force is exerted on the plug and socket members A and B, thus releasing the buckle.

Further, if the legs C of the plug member A is inserted into the socket portion E of the socket member B off a predetermined locking position by error, it would be a cause for possible damage to the buckle.

SUMMARY OF THE INVENTION

It is an object of this invention to provide measures against disengagement of a plug member from a socket member unless a proper releasing operation takes place.

Another object of the invention is to realize a snap buckle in which a plug member can be prevented from being inserted into a socket member off a predetermined locking position, thus securing a normal locking operation and making both the plug and socket members free of damage.

According to an aspect of the invention, there is provided a snap buckle comprising a flat tube shaped socket member and a plate shaped plug member releasably insertable into the socket member, wherein the plug member 1 has a base, a pair of resilient locking strips projecting in a common direction from the base, each locking strip having on its outer surface an engaging portion, and a pair of guide strips projecting in the common direction from the base so as to be located outwardly of the locking strips and having a length smaller than the locking strips, each guide strip having an inner edge portion substantially in alignment with the respective engaging portion, and wherein the socket member has a pair of locking walls engageable with the respective engaging portions of the locking strips when the plug member is inserted into the socket member, and a pair of inwardly bent resilient push levers extending from opposite outermost surfaces of a socket mouth edge and terminating in a pair of pushing portions resiliently contactable with the locking strips when the plug member is inserted into the socket member.

As another feature of the invention, the plug member has a fitting projection extending from the base and having a central recess, and the socket member has a central partition wall adapted to be received in the central recess of the fitting projection when the plug member is inserted into the socket member. As still another feature, the socket member also has a pair of auxiliary walls at a side remote from the socket mouth edge, each auxiliary wall being located between the central partition wall and the respective locking wall and being shorter than the central partition wall.

In use, the locking strips juxtaposed on the base of the plate shaped plug member are inserted into the flat tube shaped socket member between the locking walls from the socket mouth edge, as the locking strips are resiliently deformed, until engaging portions of the locking strips come into engagement with the respective locking walls of the socket member. Thus the engagement of the plug and socket members, has been completed.

For releasing the plug member from the socket member, the pushing portions of the push levers at the opposite outermost surfaces of the tube of the socket member are inwardly pushed by fingers to resiliently deform the locking strips in resilient contact with the pushing portions. As a result, the locking walls of the socket member will come out of engagement with the respective engaging portions and, at the same time, the plug member will be flipped out from the socket member under the resilience of the locking strips of the plug member. Thus the releasing operation of the buckle has been completed.

DETAILED DESCRIPTION

A snap buckle embodying this invention will now be described in detail with reference to the accompanying drawings.

Figure 1:
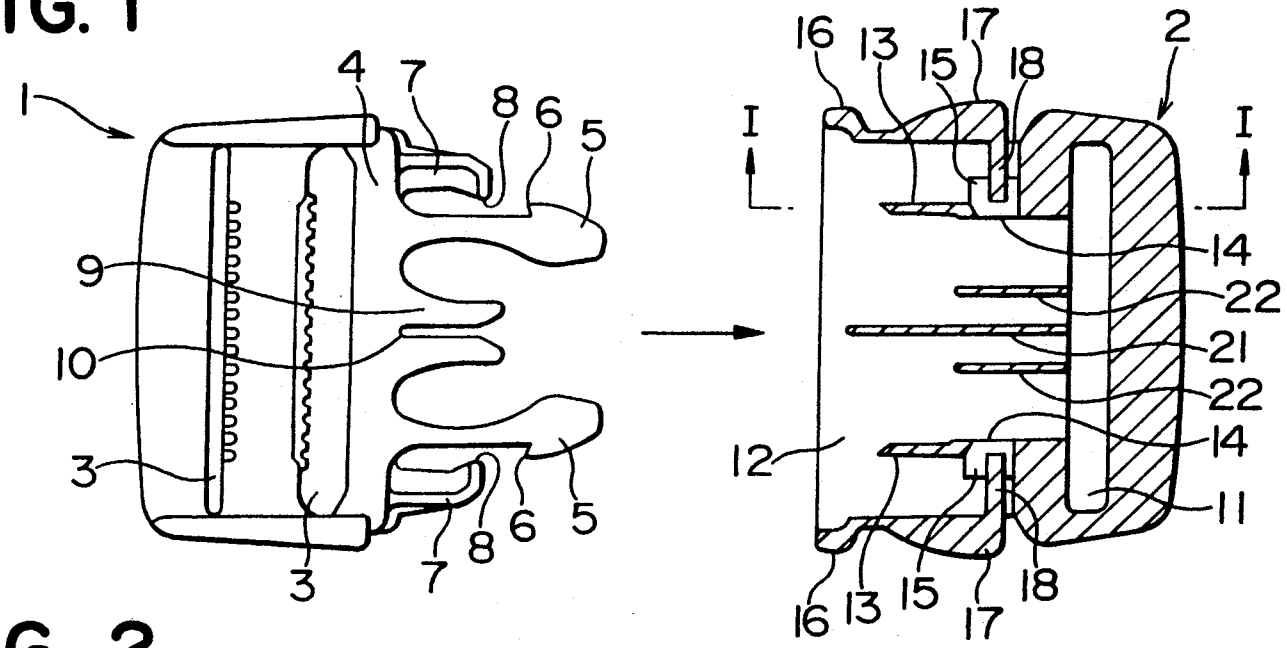
FIG. 1 is a plan view, partially in cross section, of plug and socket members to be coupled together.
Figure 2:
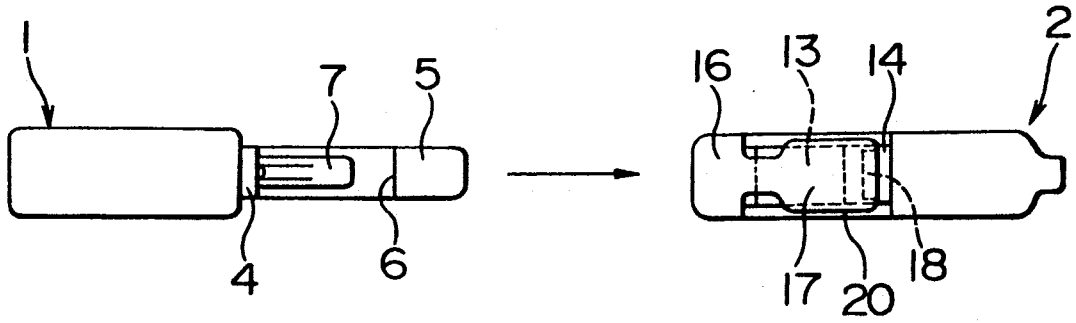
FIG. 2 is a side view of the plug and socket members to be coupled together.
Figure 3:
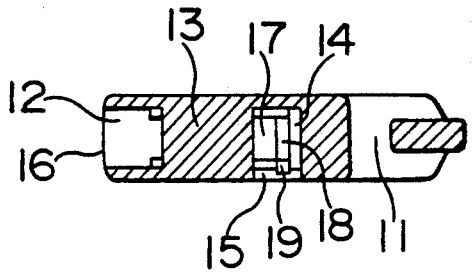
FIG. 3 is a cross-sectional view taken along line I–I of FIG. 1.
Figure 4:
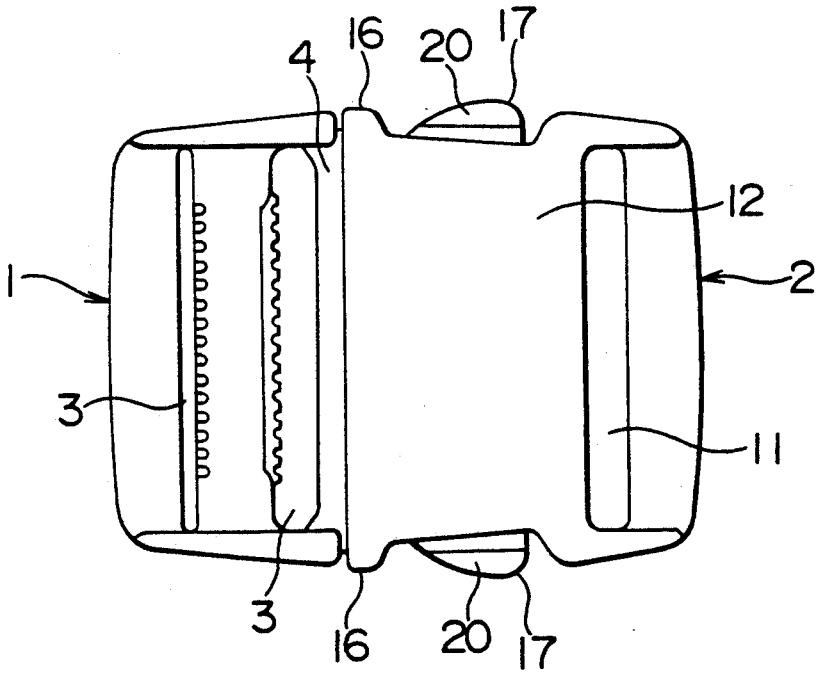
FIG. 4 is a plan view of the plug and socket members coupled together.
Figure 5:
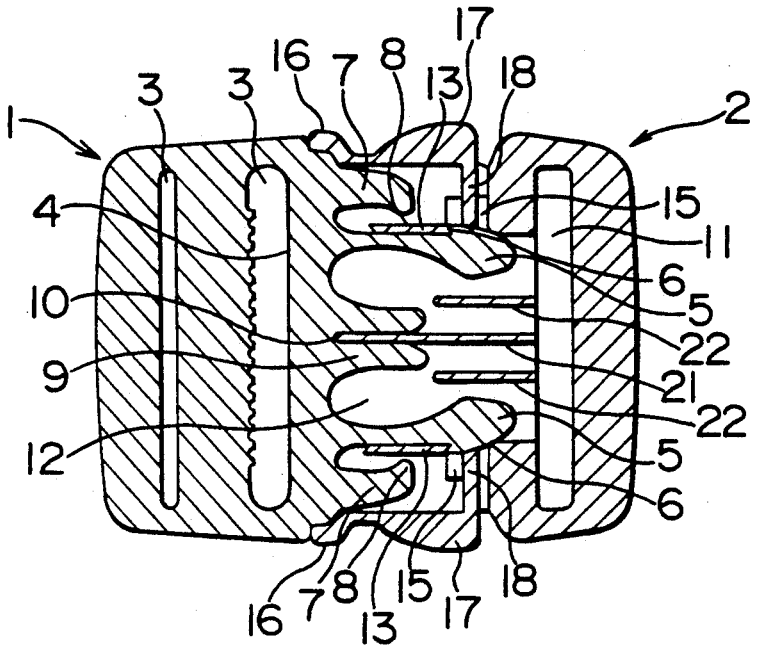
FIG. 5 is a cross-sectional view of the plug and socket members coupled together.
Figure 6:
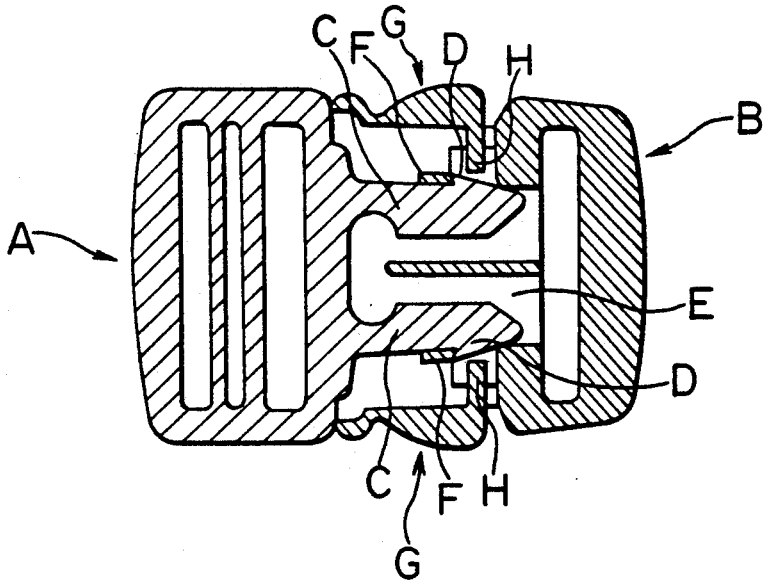
FIG. 6 is a cross-sectional view of a prior art snap buckle.

The snap buckle generally comprises, as shown in FIGS. 1 through 5, a plate shaped plug member 1 and a flat tube shaped socket member 2. Either of the plug and socket members 1, 2 is of a unitary form molded of synthetic resin such as polyamide, polyacetal or polypropylene.

The plug member 1 is in the form of a plate including a base 4 having belt insertion holes 3 at one end, and a pair of locking strips 5 projecting in a common direction from the base 4. Each locking strip 5 has an engaging portion 6 outwardly projecting from its free end, and is reduced in thickness at its root so as to secure adequate resiliency. Alternatively, such resiliency may be secured by punching out the locking strip 5 centrally.

The plug member 1 has a pair of flat headed guide strips 7 projecting from the base 4 outside the locking strips 5 and terminating in a pair of slightly inwardly directed hook-shape end. Each guide strip 7 has an inner edge portion 8 adapted to be located substantially in alignment with the engaging portion 6 of the respective locking strip 5. The plug member 1 also has a fitting projection 9 extending centrally from the base 4 and having a central recess 10 in the form of a single deep groove.

On the other hand, the socket member 2 has at one end a belt insertion hole 11 and includes a flat tube 12 having at opposite sides a pair of locking walls 13 engageable with the engaging portions 6 of the respective locking strips 5. The flat tube 12 also has a pair of openings 14 toward the belt insertion hole 11 and a pair of corner holes 15, in the back wall of the tube 12, corresponding to the respective openings 14.

The inwardly bent push levers 17 connected at its base to the socket mouth edge 16 resiliently contact the outermost side surfaces of the tube 12, and the pushing portions 18 formed on the ends of the respective push levers 17 is projecting into the openings 14 so as to come into resilient contact with the heads of the locking strips 5 when the plug member 1 is inserted into the socket member 2. Each pushing portion 18 has at one side a stopping end projection 19 loosely received in the respective corner holes 15 of the back wall of the tube 12 for restricting the pivotal movement of the individual push levers 17. Each push lever 17 also has a wide pressure flange 20 on its outer surface for easy pushing operation.

Further, the tube 12 has a central partition wall 21 extending along its substantially entire length and adapted to be received in the central recess 10 of the fitting projection 9 of the plug member 1. The tube 12 also has a pair of auxiliary walls 22 between the central partition wall 21 and the respective locking walls 13, each auxiliary wall 22 being shorter than the central partition wall 21 and located on the side toward the belt insertion hole 11.

However, the inner edge portion 8 of each guide strip 7 of the plug member 1 is not necessarily located in alignment with the engaging portion 6 of the respective locking strip 5. For example, if the thickness of the locking wall 13 is greater than that of the engaging portion 6 by more than necessary, the guide strip 7 must be shifted backwards to an extent corresponding to such thickness so that the inner edge portion 8 can be brought into moderate contact with the side surface of the locking wall 13.

As described in the foregoing description, in use, when the locking strips 5, the guide strips 7 and the fitting projection 9, all of which extend from the base 4 of the plug member 1, are inserted into the tube 12 of the socket member 2, the engaging portions 6 of the locking strips 5 will come into engagement with the locking walls 13 of the socket member 2 and, at the same time, the inner edge portions 8 of the guide strips 7 will come into moderate contact with the side surface of the locking walls 13, and further the pushing portions 18 of the push levers 17 will come into resilient contact with the heads of the respective locking strips 5. Furthermore, the partition wall 21 will be received in the central recess 10 of the fitting projection 9.

The snap buckle of this invention has the following results:

The plug member 1 has on the base 4 a pair of resilient locking strips 5, and a pair of guide strips 7 outside the locking strips 5. Each has on its outer surface an engaging portion 6. Each guide strip 7 is shorter than the respective locking strip 5 and has an inner edge portion 8 substantially in alignment with the respective engaging portion 6. On the other hand, the socket member 2 has a pair of locking walls 13 and a pair of resilient and inwardly bent push levers 17 extending from opposite outermost surfaces of the socket mouth edge 16 and terminating each in a pushing portion 18 resiliently contactable with the respective locking strip 5. Assuming that the engaging portions 6 of the locking strips 5 are in engagement with the locking walls 13, since the inner edge portions 8 of the guide strips 7 outside the locking strips 5 are located substantially in alignment with the engaging portions 6 and are in moderate contact with the side surfaces of the locking walls 13, the inner edge portions 8 of the guide strips 7 will strike the locking walls 13 to prevent the locking walls 13 from being accidentally disengaged from the locking strips 5 even when an unexpected force is exerted on the buckle, thus allowing nothing except the normal releasing operation. Yet if one of the engaging portion 6 is released from the companion locking wall 13, one inner edge portion 8 will push the companion locking wall 13 to prevent any angular movement of the plug member 1, which will in turn prevent the other inner edge portion 8 from being released from the companion locking wall 13.

Because of the guide strips 7, when the plug member 1 is inserted into the socket member 2 off a predetermined position, the guide strips 7 come into contact the socket mouth edge 16 of the socket member 2 to guide the plug member 1 to the proper position in the socket member 2.

Since the central partition wall 21 is received in the central recess 10 of the fitting projection 9, the plug and socket members 1, 2 cannot suffer a lateral mutual divergence after coupling, thus securing stable coupling. Further, since the socket member 2 has a pair of auxiliary walls 22 each shorter than the central partition wall 21 and located between the central partition wall 21 and the respective locking wall 13, the free ends of the locking strips 5 come into contact with the auxiliary walls 22 to prevent the plug member 1 from being inclined during insertion, thus preventing inclined insertion before occurring.

What is claimed is:

1. A snap buckle comprising a flat tube shaped socket member and a plate shaped plug member releasably insertable into said socket member, wherein said plug member has a base, a pair of resilient locking strips projecting in a common direction from said base, each locking strip having on its outer surface an engaging portion, and a pair of guide strips projecting in said common direction from said base so as to be located outwardly of said locking strips and having a length smaller than said locking strips, each guide strip having an inner edge portion substantially in alignment with the respective engaging portion, and wherein said socket member has a pair of locking walls engageable with the respective engaging portions of said locking strips when said plug member is inserted into said socket member, and a pair of inwardly bent resilient push levers extending from opposite outermost surfaces of a socket mouth edge and terminating in a pair of pushing portions resiliently contactable with said locking strips when said plug member is inserted into said socket member.

2. A snap buckle according to claim 1, wherein said plug member has a fitting projection extending from said base and having a central recess, and said socket member has a central partition wall adapted to be received in said central recess of said fitting projection when said plug member is inserted into said socket member.

3. A snap buckle according to claim 2, wherein said socket member also has a pair of auxiliary walls at a side remote from said socket mouth edge, each auxiliary wall being located between said central partition wall and the respective locking wall and being shorter than said central partition wall.

4. A snap buckle according to claim 1, wherein said socket member also has a pair of auxiliary walls at a side remote from said socket mouth edge, each auxiliary wall being located between said central partition wall and the respective locking wall and being shorter than said central partition wall.

* * * * *